US006029373A

United States Patent [19]

Diradour et al.

[11] Patent Number: 6,029,373

[45] Date of Patent: Feb. 29, 2000

[54] STITCH-DOWN SAFETY SHOE

[75] Inventors: Richard G. Diradour, Mississauga; Constantin Tzenos, Stoney Creek, both of Canada

[73] Assignee: Gredico Footwear Ltd., Mississauga, Canada

[21] Appl. No.: 09/177,737

[22] Filed: Oct. 23, 1998

[51] Int. Cl.[7] ..... A43B 9/10; A43C 13/14

[52] U.S. Cl. ..... 36/12; 36/107; 36/77 R; 36/16

[58] Field of Search ..... 36/12, 107, 77 R, 36/16, 18

[56] References Cited

U.S. PATENT DOCUMENTS

| | | | |
|---|---|---|---|
| 2,123,278 | 7/1938 | Fredericksen . | |
| 2,426,211 | 8/1947 | Heckman | 36/77 R |
| 2,720,042 | 10/1955 | Marcy | 36/68 |
| 3,034,235 | 5/1962 | Hunting et al. . | |
| 4,011,667 | 3/1977 | Greenam . | |
| 4,451,949 | 6/1984 | Long . | |
| 4,566,197 | 1/1986 | Sitzea . | |
| 4,597,199 | 7/1986 | Hong | 36/77 R |
| 4,908,963 | 3/1990 | Krajcir et al. | 36/77 R |
| 5,189,814 | 3/1993 | Barma | 36/68 |

FOREIGN PATENT DOCUMENTS

| | | |
|---|---|---|
| 1110060 | 10/1981 | Canada . |

*Primary Examiner*—M. D. Patterson
*Attorney, Agent, or Firm*—Renner, Kenner, Greive, Bobak, Taylor & Weber

[57] ABSTRACT

The present invention is directed to a safety shoe having improved characteristics of flexibility, weight and style. The shoe, which is of stitch-down construction incorporates a metal toe box retainer which fits within the metal toe box and holds the metal toe box in place. The metal toe box has flanges which fit under the edges of the metal toe box retainer. Durability and comfort are achieved by means of a liner which is lasted to the interior surface of the metal toe box and wraps around and under the retainer.

9 Claims, 6 Drawing Sheets

STITCH-DOWN SAFETY SHOE

FIELD OF THE INVENTION

The present invention is directed to the field of safety shoes, particularly those incorporating metal toe boxes.

BACKGROUND OF THE INVENTION

Safety shoes designed to protect feet from common hazards such as falling or rolling objects, cuts and punctures are well known. Such shoes are required personal protective equipment for many occupations. According to the Occupational Safety and Health Administration (OSHA), safety shoes should be sturdy and have an impact resistant toe. Often the entire toe box and insole are reinforced with steel. Sometimes the instep is protected by steel, aluminum or plastic materials. Safety shoes are also usually equipped with special soles to guard against slip, chemical, and/or electrical hazards. Thus, safety shoes and boots protect the feet, help prevent injuries to them, and reduce the severity of injuries that do occur in the workplace. Yet, only one out of every four victims of a job-related foot injury were wearing any type of safety shoes or boot. The most common reason for this is that workers often complain about the comfort and/or style of the safety shoes available. The present invention addresses these problems by providing a safety shoe which is comfortable, flexible, stylish, and still provides protection from injury. This surprising result is accomplished through the application of stitch-down shoe construction to safety shoe technology.

Stitch-down construction for shoes in general has long been known, as illustrated, for example, in U.S. Pat. No. 2,123,278 which issued in 1938. However, it has not been accepted in the safety shoe industry because of the difficulty of trying to include a steel toe box into the constructions.

Moccasin type safety shoes have been described in U.S. Pat. Nos. 4,451,949 and 4,566,197. While these shoes have a casual style, this type of shoe often does not have the sturdiness and long life required in safety shoes.

Welt type construction for shoes is generally considered to be very strong. Welt shoes are also generally favoured because they can be easily resoled. A problem encountered when trying to make welt type safety shoes is the fact that the steel toe box generally has inwardly extending flanges which are normally at least 3/16 inch. These flanges are necessary to distribute forces applied to the top of the toe box sufficiently to comply with OSHA regulations relating to the acceptable amount of depression of the toe box in response to various tests. Canadian Patent 1,110,060 and U.S. Pat. No. 3,034,235 provide a groove in the mid-sole to accommodate the flanges and therefore reduce the profile of the steel toe box for easier welting. However, this adds to the cost of manufacture and the reduced profile of the toe means that these shoes will not pass the most rigorous OSHA depression requirements.

Another type of safety shoe incorporating a typical welt type of construction is disclosed in U.S. Pat. No. 4,011,667. As can be gathered from this U.S. patent, welt type safety shoes are difficult to manufacture and result in a very bulky joint around the edges. While welt type shoes are generally considered to be of sturdy construction, they also have the disadvantages that they are heavy, inflexible and generally conservative in style, thus contributing to the problem that workers do not always wear the personal protective equipment available to them. The present invention addresses this problem through the surprisingly result that OSHA compliant safety shoes which are lightweight, flexible and stylish can be manufactured using stitch-down construction.

SUMMARY OF THE INVENTION

It is an object of an aspect of this invention to provide a safety shoe with improved flexibility, durability, comfort and style. More specifically, this invention provides a safety shoe of flexible stitch-down construction. The safety shoe of the present invention comprises a) a shoe upper, b) a metal toe box, having inturned flanges, c) a metal toe box retainer fitted into the metal toe box d) a liner disposed under the shoe upper and lasted to an interior surface of the metal toe box, e) a stitch-down board, and f) an outer sole. The liner extends beyond the metal toe box and is tucked under the retainer and glued to the bottom surface of the retainer. Methods for making this type of shoe are also provided.

BRIEF DESCRIPTION OF THE DRAWINGS

Preferred embodiments of the invention are described with respect to the drawings wherein.

DETAILED DESCRIPTION OF THE PREFERRED EMBODIMENTS

The present invention is directed to a safety shoe of stitch-down construction. The novel type of safety shoe is flexible, lightweight and casual in style yet meets all OSHA standards. The construction of the shoe is described in detail below having regard to the FIGS. 2 through 5.

Figure 1:
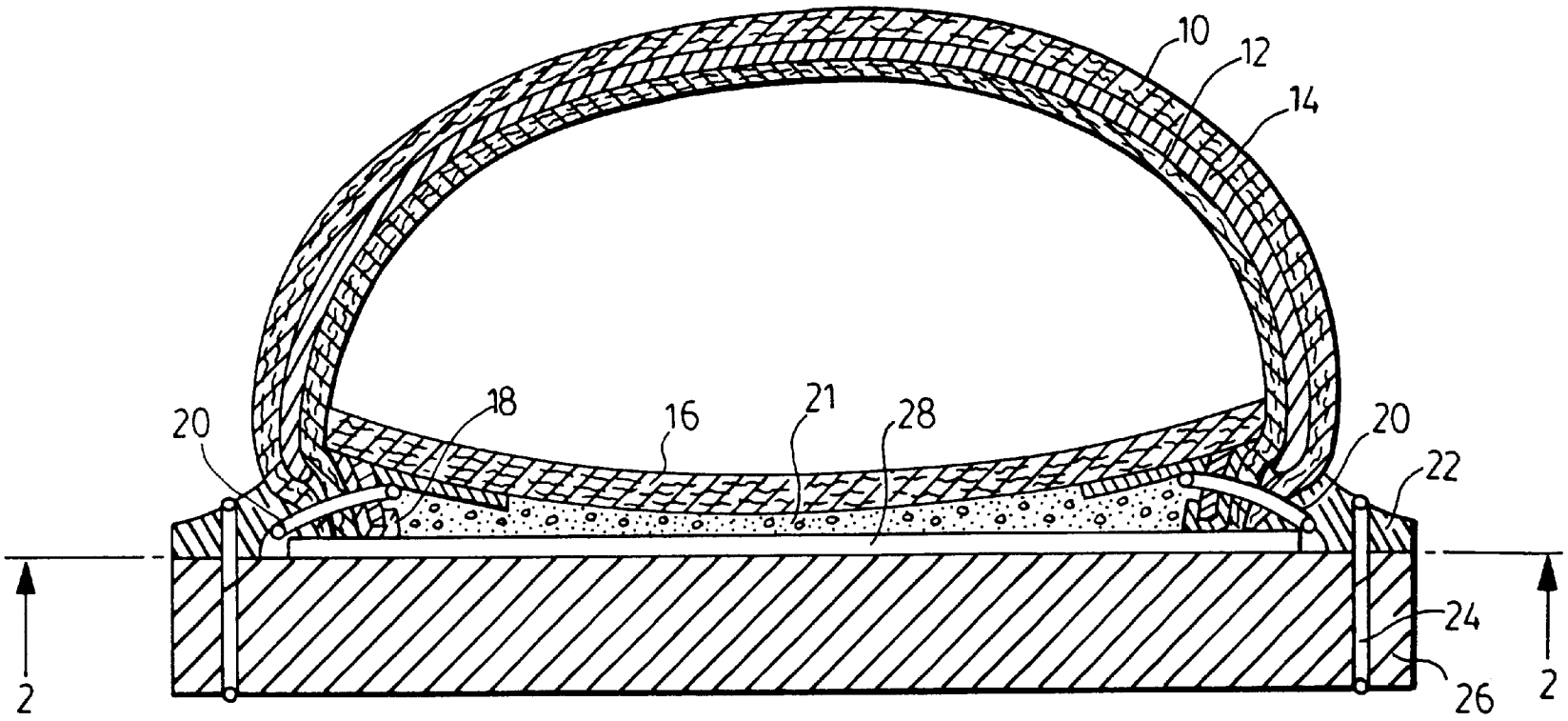
FIG. 1. (PRIOR ART)
FIG. 1 is a cross-section through a safety shoe of prior art welt-type construction.

As shown in FIG. 1 of aforementioed U.S. Pat. No. 4,011,667 a welt shoe is assembled in customary fashion. This discussion of the prior art is provided to emphasize the advantages of applicant's stitch down construction. There is provided an upper 10 and a lining 12 between which is disposed a flangeless steel box toe 14. The composition and dimensions of the steel toe 14 are such as to provide the required resistance to forces exerted on the toe portion of the shoe. The steel toe employed in the practice of U.S. Pat. No. 4,011,667 has a rounded lower edge producing what might perhaps be termed a vestigial flange since it has a span of less than 1/16 inch. Its purpose is merely to provide a relatively blunt lower edge. The upper and lining are lasted as usual to a sewing rib 18 secured to the lower surface of a conventional insole 16. Then the overlasted margins of the upper and lining and a welt 22 are secured to the sewing rib 18 by a line of stitching 20 formed in the conventional inseaming operation. The next step is to trim the overlasted margins of the upper 10 and lining 12, following which the usual filler 21 is disposed in the are inside the sewing rib 18.

In the next operation a steel stress absorbing plate 28 is secured to the bottom of the shoe by cement, tacks, or other securing means. The stress absorbing plate is substantially in the form of a rhomboid or rectangle. The plate 28 spans a portion of the toe area from a line lying in a plane with the rear edges of the steel box toe to a line somewhat to the rear of the forward end of the shoe. It is vitally important that the outer periphery of the plate 28 terminate inside the line where the outseam will be formed. In order to provide sufficient tolerance the outer periphery of the plate 28 is adjacent the line of the inseam stitches. The periphery terminates slightly inside the inseam stitches so that the operator has a visible guide to assist him in positioning the plate 28 properly.

After the plate 28 has been secured in place, an outsole 26 is secured to the welt 22 by means of a line of stitching 24, the operation being carried out on the customary outsole rapid lock stitch machine.

Figure 2:
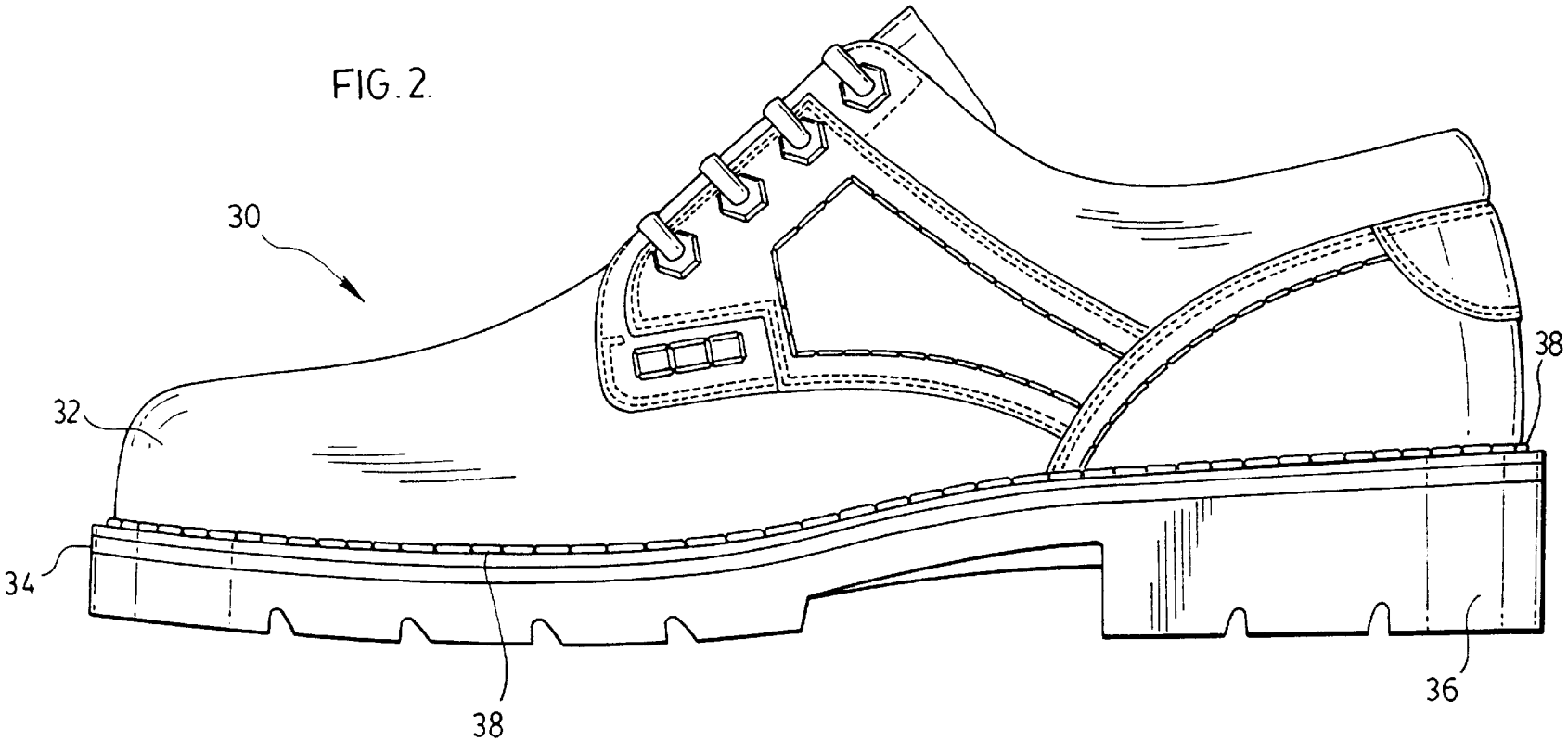
FIG. 2 is a side elevational view of a preferred embodiment.

FIG. 2 illustrates a preferred embodiment of a stitch-down safety shoe generally indicated at 30. The shoe upper 32 is attached by a series of stitches 38 to a sole board 34 which is glued to the outer sole 36. Although a preferred design is illustrated, it is clearly apparent that the style may be varied without changing the basis of the construction. The shoe may also comprise additional features not specifically described. For example, the shoe upper may be leather or a fluid resistant material depending on the situation. The shoe may be designed to insulate against temperature extremes and may be equipped with special soles to guard against slip, chemical and/or electrical hazards. The steel toe box may be insulated for electrical applications. The sole may be soft and comprised of shock absorbing material to provide for added comfort.

Figure 3A:
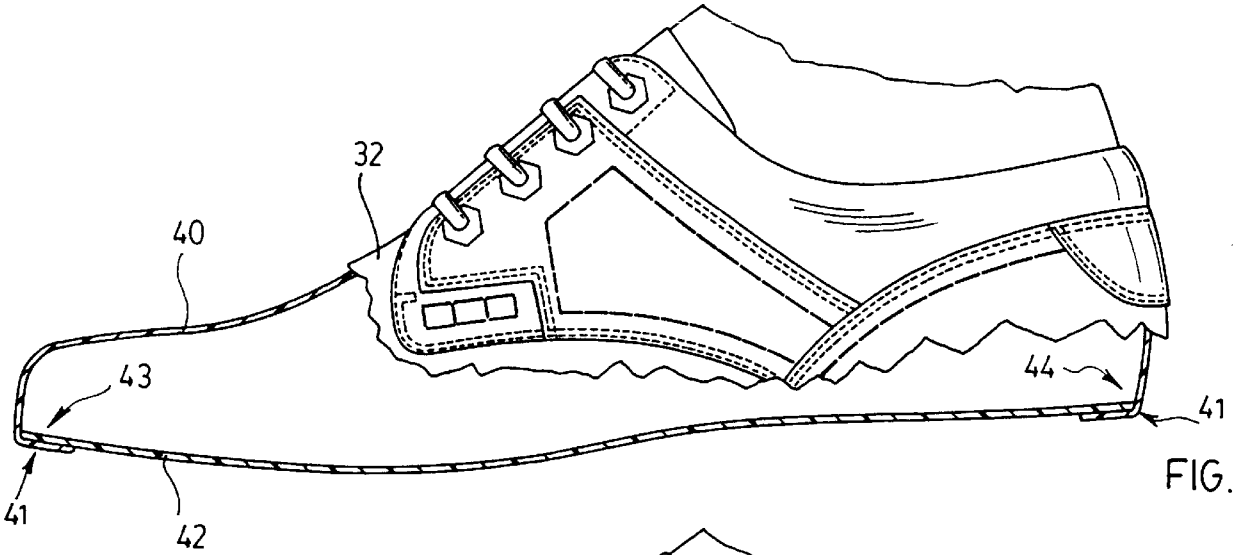
FIGS. 3A through 3D illustrate how a preferred embodiment is constructed.
Figure 3B:
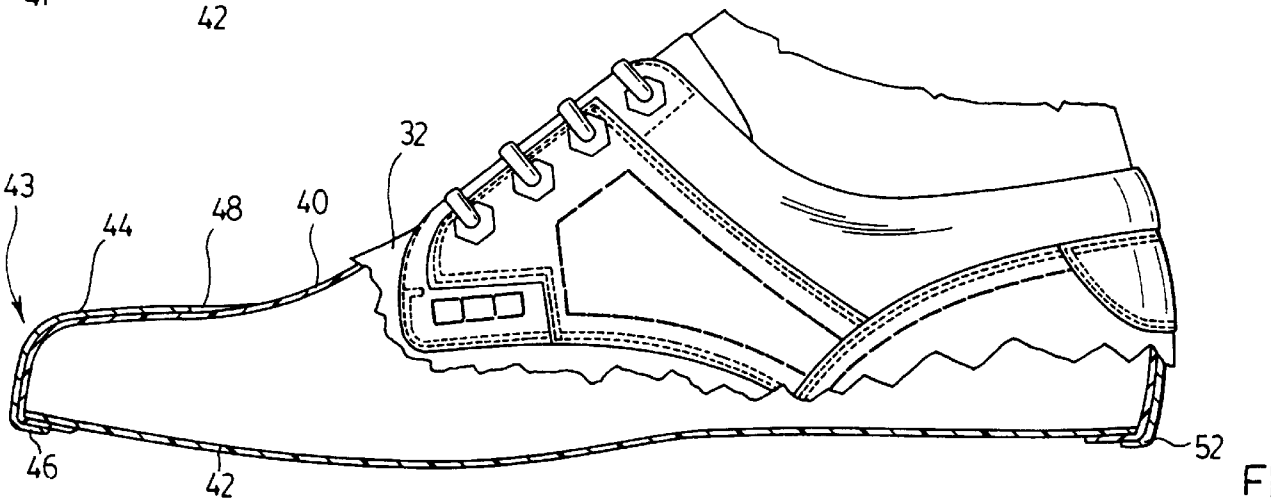

Referring now to FIGS. 3A–3D, the relationship between the various components of the shoe of the present invention are illustrated. FIG. 3A shows a liner 40 disposed below the upper 32 and extending around and under at 41 for both the toe end generally designated 43 and optionally the heel end generally 44, of a steel toe box retainer 42. The retainer is generally fabricated from a material having sufficient strength that its shape is not easily distorted. Examples of material from which the retainer could be made include leather fibre board, plastic fibre reinforced materials, carbon fibre reinforced materials and the like. The fact that the liner extends around and under the retainer has the surprising result that the shoe is comfortable and the steel toe remains firmly in position when the retainer is secured within the shoe. In addition, wrapping the liner under the retainer provides a more attractive appearance for the shoe or boot because the liner is not visible along the sole side as would be the case with traditional stitch down construction as discussed with respect to FIG. 1. The retainer fits into a steel toe box 44 such that the toe box flanges 46 extend under the retainer 42. The retainer is secured to the board 34 if it is shorter than the full inner length of the shoe otherwise the retainer abutting the heel of the shoe retains the steel toe box in place. The retainer is positioned to locate the steel toe box 44 to ensure that it does not move in the assembled shoe. The retainer is designed to resist any movement of the box 44 such as would be caused by a direct impact on the end of the boot. The liner 40 is lasted to the interior surface of the toe box and extends beyond the flanges 46 under the retainer 42. A strip of rubber 48 may be optionally inserted between the steel toe box upper edge 50 and the liner 40. Although the liner extends past the steel toe box and therefore provides a barrier between the wearer and the metal toe box, addition of the rubber or other flexible material provides for added comfort during flexing of the shoe and may also contribute to the shock resisting capacity of the steel toe box 44. The rubber strip may also be relied on to smooth out the transition between steel toe cap and leather upper so that the steel cap does not stand out in the shoe upper profile. Another option, not illustrated, is to glue an insole to the retainer and have the liner wrap around the two. This could be a cushioned insole for example. Disposable insert soles, such as those designed to control odor can also be used in concert with the present invention.

For added strength, a counter 52 is optionally applied to the rear of the shoe over the liner 40 to enhance the ability of the retainer 42 to hold the steel toe box 44 in position.

Figure 3C:
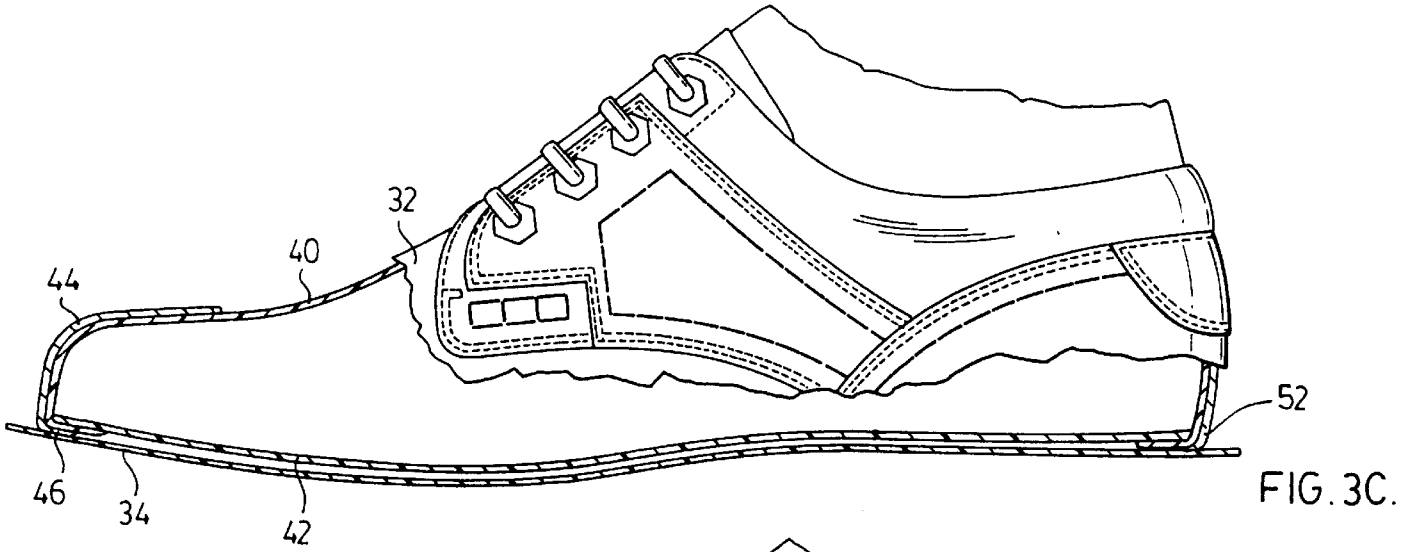

FIG. 3C illustrates the addition of a stitch-down board or midsole 34. In stitchdown construction, the upper 32 generally has an outwardly extending margin which is stitched to some sort of platform. Depending on the potential hazards to be encountered, the stitching may be of natural or synthetic material.

Figure 3D:
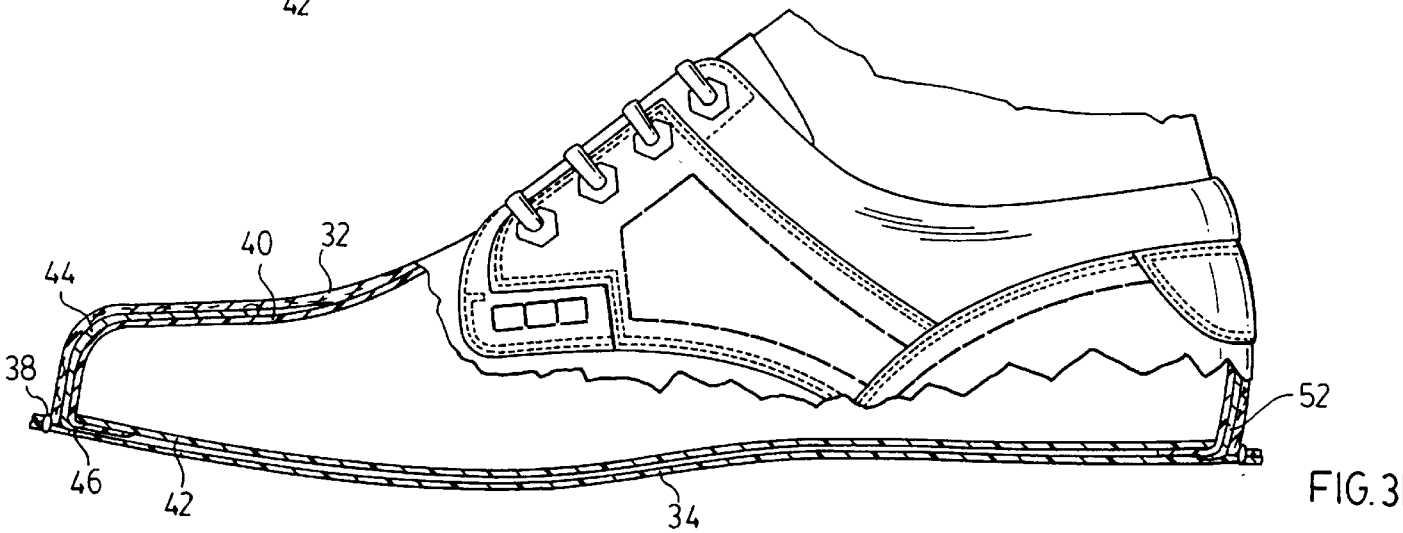

FIG. 3D illustrates how the shoe upper 32 is pulled over the steel toe box 44 and attached to the board 34 by a series of stitches 38.

Figure 4:
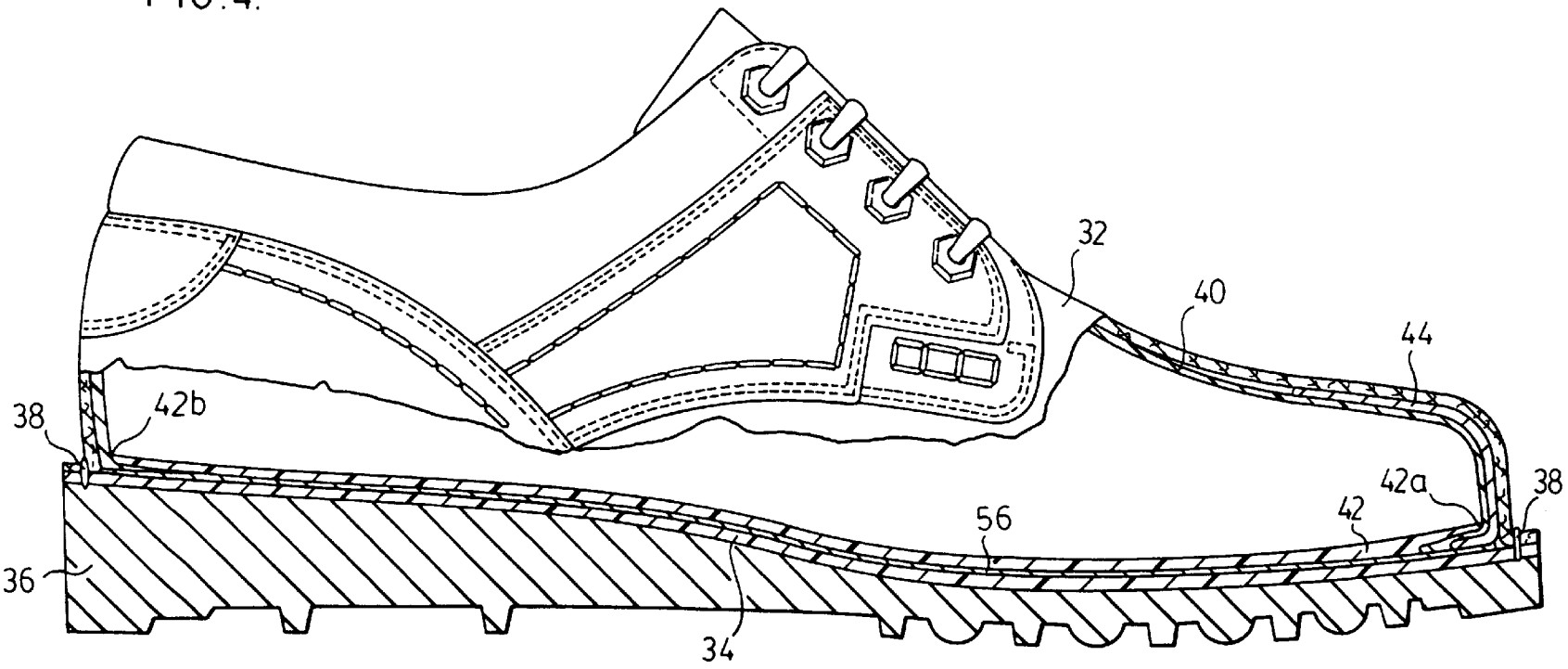
FIG. 4 is a section through a preferred embodiment with the upper part shown in elevation.

FIG. 4 illustrates the completed shoe in cross-section. The liner 40 is shown beneath the shoe upper 32 and extending around and under the retainer 42. The steel toe box 44 has the liner 40 fitted thereunder with the box flanges 46 extending under the retainer 42. The retainer 42 is shown as extending from the toe box inner end at 42*a* to the heel inner end at 42*b*. The heel end at 42*b* serves to hold the toe box in place due to the rigid nature of the retainer 42 in a lengthwise direction. The embodiment illustrates an optional steel plate 56 extending along the length of the shoe. The steel plate 56 is designed particularly to protect against puncture wounds from nails and the like.

The leather upper 32 extends over the steel toe and is attached to a board 34 which is glued to an outer sole 36 by stitches 38.

Figure 5:
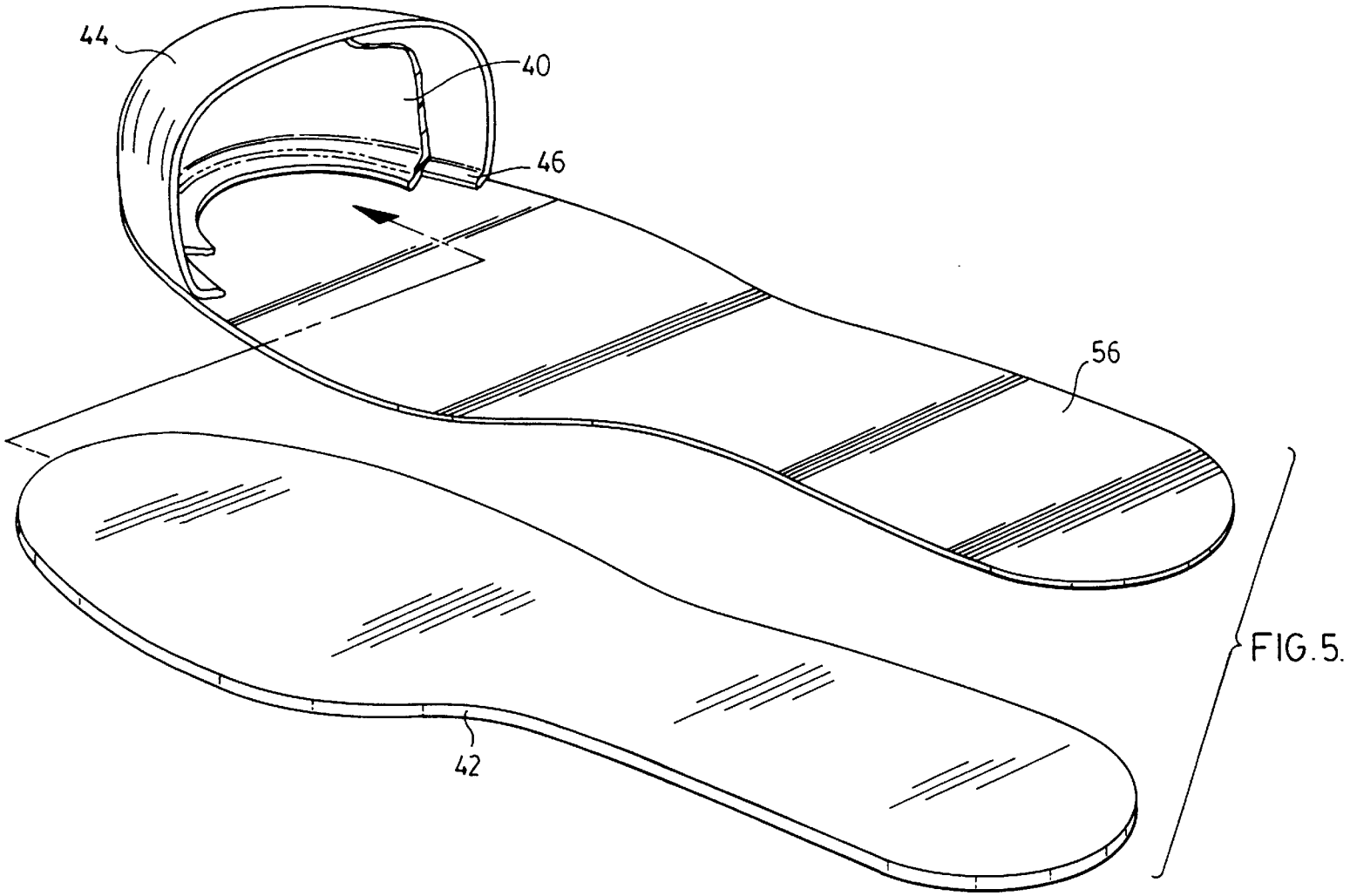
FIG. 5 illustrates how the retainer fits into the steel toe box.

FIG. 5 illustrates how the retainer 42 fits within the steel toe box 44. Normally, the steel toe box rests on a metal plate 56. Downward forces on the toe box are transferred along the flanges and to the steel plate. This configuration is very effective in preventing depression of the toe box. The retainer 42 fits inside the toe box and over the flanges 46. The liner 40 covers the inside of the toe box 44 and wraps around and under the retainer 42.

Although preferred embodiments of the invention have been described herein in detail, it will be understood by those skilled in the art that variations may be made thereto without departing from the spirit of the invention or the scope of the appended claims.

We claim:

1. A safety shoe of stitch-down construction comprising:

i) a shoe upper, ii) a metal toe box, having inturned flanges, iii) a metal toe box retainer fitted into said metal toe box iv) a liner disposed under said upper and lasted to an interior surface of said metal toe box v) a stitch-down board, and vi) an outer sole wherein said liner extends beyond said metal toe box under said retainer.

2. The shoe of claim 1 wherein said metal toe retainer extends the full length of the shoe.

3. The shoe of claim 2 further comprising an inner sole lasted to said retainer.

4. The shoe of claim 2 further comprising a counter at the heel end of said shoe.

5. The shoe of claim 1 further comprising a metal foot plate.

6. The shoe of claim 5 wherein said foot plate is disposed between said retainer and said outer sole.

7. The shoe of claim 5 wherein said foot plate extends the length of the shoe.

8. The shoe of claim 1 further comprising flexible material between said metal toe box and said liner.

9. A method of constructing a stitch-down safety shoe comprising the steps of:

i) inserting a liner within a shoe upper ii) wrapping a liner around and under a steel toe box retainer iii) fitting said liner and retainer into a steel toe box iv) lasting said liner to the interior surface of a steel toe box v) securing said retainer to a stitch-down board vi) stitching an outwardly extending margin of said upper to said stitch-down board, and vii) attaching said board to an outer sole.

* * * * *